US007097572B2

(12) United States Patent
Yabu

(10) Patent No.: US 7,097,572 B2
(45) Date of Patent: Aug. 29, 2006

(54) GOLF CLUB HEAD

(75) Inventor: Masanori Yabu, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/766,836

(22) Filed: Jan. 30, 2004

(65) Prior Publication Data

US 2004/0185962 A1 Sep. 23, 2004

(30) Foreign Application Priority Data

Feb. 5, 2003 (JP) ..... 2003-028638

(51) Int. Cl.
*A63B 53/04* (2006.01)
*A63B 53/06* (2006.01)

(52) U.S. Cl. ..... 473/329; 473/345

(58) Field of Classification Search ..... 473/324–350
See application file for complete search history.

(56) References Cited

U.S. PATENT DOCUMENTS 4,928,965 A 5/1990 Yamaguchi et al.
5,346,217 A * 9/1994 Tsuchiya et al. ..... 473/345
6,471,604 B1 * 10/2002 Hocknell et al. ..... 473/334
6,524,194 B1 * 2/2003 McCabe ..... 473/305
6,533,681 B1 * 3/2003 Inoue et al. ..... 473/342
6,852,038 B1 * 2/2005 Yabu ..... 473/224
2003/0104878 A1 * 6/2003 Yabu ..... 473/345

FOREIGN PATENT DOCUMENTS

JP 2000144286 A * 5/2000
JP 2003159354 A * 6/2003

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

A hollow metal club head comprises a face portion whose front surface defines the club face, and a turnback wall extending backward from the circumferential edge of the face portion, wherein a head volume is in a range of not less than 440 cc, a height of the club face is in a range of from 55 to 85 mm, and a surface area of the club face is in a range of from 4000 to 6500 sq. mm. In a front end zone of the turnback wall and a peripheral zone of the face portion which are adjacent to each other through a junction between the turnback wall and the face portion, the ratio Rf/Rh of a zone rigidity $Rf=(Ef \times tf^3)$ of the peripheral zone to a zone rigidity $Rh=(Eh \times th^3)$ of the front end zone is in a range of from 4.0 to 12.0.

9 Claims, 10 Drawing Sheets

Heel
F
20mm
S
12
Pa2
T
Toe
Recorder
FFT-based signal analyzer
Processing and power-supplying unit
Power amplifier
α 2
α 1
Pa2
Pa1

1
T
2
Pa2
15
12
S
Pa1
13

GOLF CLUB HEAD

This Non-provisional application claims priority under 35 U.S.C. § 119(a) on Patent Application No. 2003-028638 filed in JAPAN on Feb. 5, 2003, the entire contents of which are hereby incorporated by reference.

BACKGROUND OF THE INVENTION

The present invention relates to a large-sized golf club head, more particularly to a structure for the vicinity of the club face edge being capable of improving rebound performance.

In recent years, in order to increase the travelling distance of a ball, there have been made various efforts to approximate the primary frequency of a golf club head to the primary frequency of the golf balls, at which primary frequency the mechanical impedance shows the first order's local minimum.

On the other hand, the trend of wood-type club head is toward a large head volume.

In a large-sized wood-type club head, as the weight of the head is limited, the thickness is inevitably decreased as the volume is increased. The decreasing of the material thickness and increasing of the size, especially in the face portion result in a lowering of the primary frequency. Thus these must be desirable for increasing the travelling distance of a ball.

In case of a very large head whose volume is over 440 cc, however, the rebound performance can not be so improved even if the primary frequency of a golf club head approximates to that of the balls.

Therefore, the inventor conducted FEM simulations of a club head at impact, using a super-computer, to analyze stress, strain, internal energy loss, vibration modes etc., and found that, as to the kinetic energy which should be transferred from the head to the ball, energy loss due to vibration is relatively large, as the amount of deformation in the face portion is very large and the amplitude of vibration is large, and that this energy loss is relatively high in the front end zone of the turnback wall adjacent to the circumferential edge of the face portion as the bending stress is liable to concentrate in the front end zone. Therefore, the inventor made various experiments and discovered that, by specifically defining a zone rigidity of the front end zone and that of a peripheral zone of the face portion, the energy loss at impact can be decreased, and the rebound performance can be effectively improved.

SUMMARY OF THE INVENTION

It is therefore, an object of the present invention to provide a golf club head of which rebound performance is effectively improved in spite of a large head volume of over 440 cc.

According to the present invention, a hollow metal club head comprises a face portion whose front surface defines a club face for hitting a ball, and a turnback wall extending backward from a circumferential edge of the face portion, wherein a head volume is in a range of not less than 440 cc, a height of the club face is in a range of from 55 to 85 mm, an area of the club face is in a range of from 4000 to 6500 sq.mm, and in a front end zone of the turnback wall and a peripheral zone of the face portion which are adjacent to each other through a junction between the turnback wall and the face portion, the ratio Rf/Rh of a zone rigidity Rf of the peripheral zone to a zone rigidity Rh of the front end zone is in a range of from 4.0 to 12.0, wherein $$Rh=Eh\times th^3$$

$$Rf=Ef\times tf^3$$

Eh is Young's modulus in GPa of the turnback wall in the front end zone, th is average thickness in mm of the turnback wall in the front end zone, Ef is Young's modulus in GPa of the face portion in the peripheral zone, and tf is average thickness in mm of the face portion in the peripheral zone.

Here, the average thickness th, tf means the area-weighted average thickness, namely, $\Sigma(ti\cdot Si)/\Sigma Si$, (i=1, 2 - - - n), wherein n is the number of the small regions of the zone, ti is the thickness of each small region, and Si is the area of the small region.

As shown in FIG. 8, when the zone is divided into small elements B having a small width Δb, a thickness t and a length corresponding with the zone width:

At the time of impact, the face portion causes a flexural deformation. Then, in the peripheral zone 5 of the face portion 2, the small element Bf causes a bending strain in a direction indicated by arrows Mf like a cantilever beam fixed at the junction as a fulcrum. In the front end zone 4, on the other hand, the element Bf is subjected to a compressive stress in the backward direction as well as a bending stress in a direction indicated by arrows Mh. When considering each small element Bf, Bf, the bending rigidity of the element Bh is given as a product Eh×Ih of the Young's modulus Eh and the geometrical moment of inertia Ih, and the bending rigidity of the element Bf is the product Ef×If of the Young's modulus Ef and the geometrical moment of inertia If. Here, the geometrical moment of inertia (If, Ih) and the cube of the thickness th, tf are in a proportionality relation (namely, $If=\Delta b\times tf^3/12$, $Ih=\Delta b\times th^3/12$). The zone rigidity Rh, Rf means the average of the bending rigidity of the elements Bh, Rf in each zone 4, 5. In this invention, the zone rigidity Rh, Rf is proposed as a novel criterion for the rebound performance of a large-sized club head larger than 440 cc.

DESCRIPTION OF THE PREFERRED EMBODIMENTS

Figure 1:
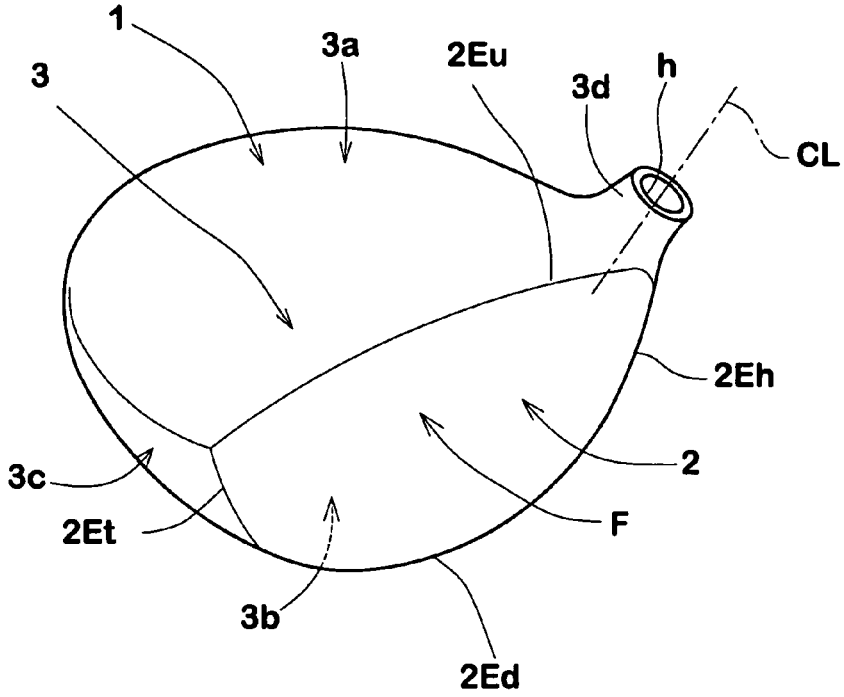
FIG. 1 is a perspective view of a club head according to the present invention.
Figure 2:
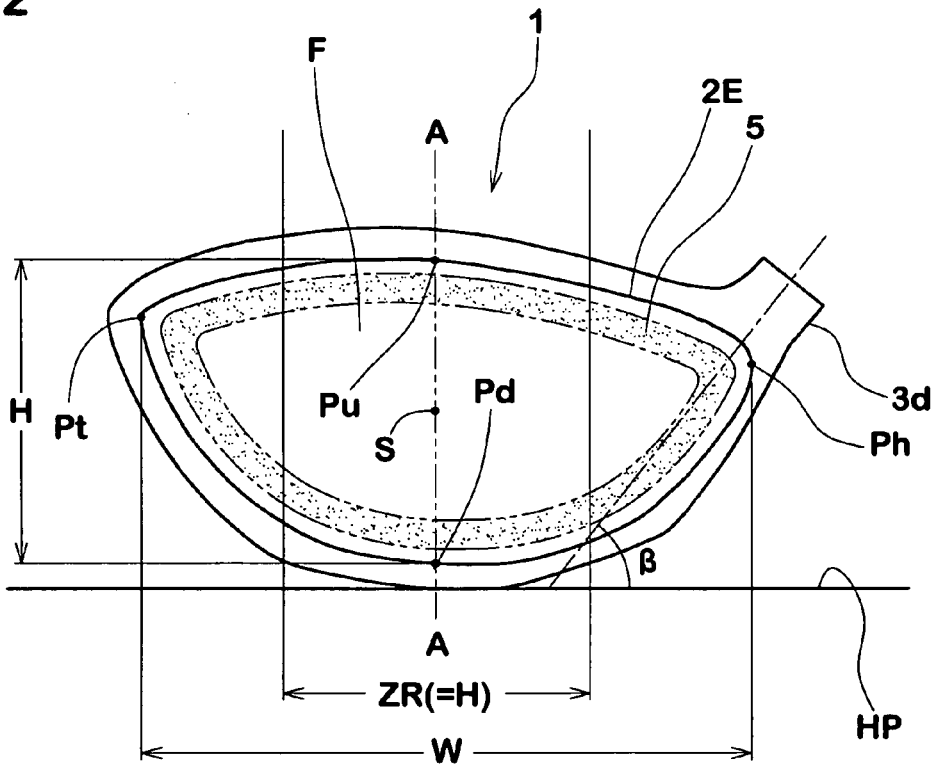
FIG. 2 is a front view thereof.

Embodiments of the present invention will now be described in detail in conjunction with the accompanying drawings.

In the drawings, golf club head 1 as an embodiment of the present invention is a hollow metal wood-type head. The head 1 comprises a face portion 2 whose front face defines a club face F for hitting a ball and back face 2B is exposed to the hollow (i), a crown portion 3*a* intersecting the club face F at the upper edge 2Eu thereof, a sole portion 3*b* intersecting the club face F at the lower edge 2Ed thereof, a side portion 3*c* between the crown portion 3*a* and sole portion 3*b* which extends from a toe-side edge 2Et to a heel-side edge 2Eh of the club face F through the back face of the club head, and an upwardly protruding hosel portion 3*d* to be attached to an end of a club shaft (not shown). The hosel portion 3*d* is provided at the upper end with a circular hole (h) for inserting the club shaft.

According to the present invention, the ratio (Rf/Rh) of the zone rigidity Rf of a peripheral zone 5 of the face portion 2 and the zone rigidity Rh of a front end zone 4 of the turnback wall 3 is set in a range of not less than 4.0 and not more than 12.0, preferably less than 10.0, more preferably less than 8.0.

Here, the turnback wall 3 is a wall which extends backward from the circumferential edge 2E(2Eu, 2Ed, 2Et and 2Eh) of the face portion 2 to support the periphery of the face portion 2. In this embodiment, therefore, the turnback wall 3 includes the crown portion 3*a*, sole portion 3*b* and side portion 3*c*.

Roughly speaking, the front end zone 4 and peripheral zone 5 are a zone defined as having a width of from about 10 mm to about 15 mm and extending from the intersection of the face portion 2 and the turnback wall 3, excepting the rigid corner of about 3 mm which functions as a fulcrum when the face portion causes a flexural deformation at impact.

Figure 6A:
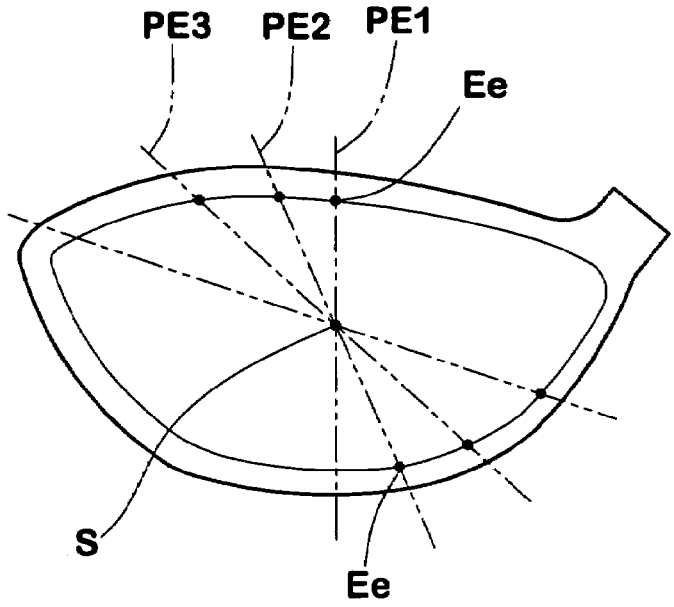
FIGS. 6*a* and 6*b* are schematic views for explaining the face edge in case of a rounded edge.
Figure 6B:
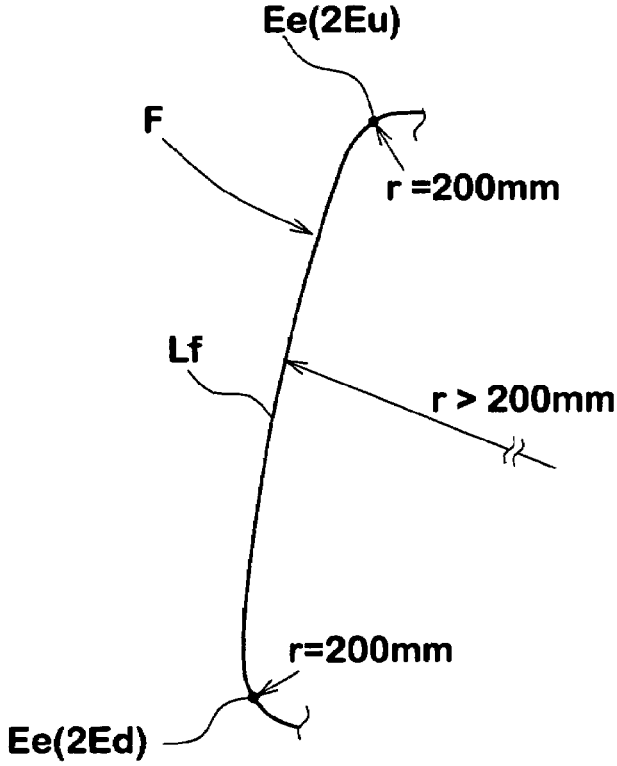

Here, the width of the front end zone 4 is defined as a backward extent along the outer surface of the turnback wall 3. The width of the peripheral zone 5 is defined as an extent towards the centroid S of the club face F. Those extents are measured as a distance from the edge 2E of the club face F for the sake of simplicity. However, if it is impossible to visually identify the edge 2E due to smooth change in the curvature, a virtual edge line (Ee) which is defined, based on the curvature change is used instead as follows. As shown in FIG. 6*a*, in each cutting plane PE1, PE2 - - - including a straight line extending between the sweet spot (centroid) S of the club face F and the center of gravity of the club head (not shown), as shown in FIG. 6*b*, a point Ee at which the radius (r) of curvature of the profile line Lf of the face portion first becomes under 200 mm in the course from the center S to the periphery of the club face is determined. Then, the virtual edge line is defined as a locus of the points Ee.

For the sake of clarity, the front end zone 4 may be defined as extending between 3 mm and 13 mm backward from the edge 2E, and the peripheral zone 5 may be defined as extending between 3 mm and 15 mm from the edge 2E towards the centroid S of the club face F.

As to the circumferential extent of the peripheral zone 5, it is preferable that the peripheral zone 5 extends continuously along the edge 2E of the club face F.

As to the circumferential extent L of the front end zone 4, it is necessary that the front end zone 4 extends along the edge 2E of the club face F at least in a central zone ZR which is centered on the centroid S in the horizontal direction and has a width corresponds to the face height H on the presupposition that the club face F is long from side to side. Thus, the minimum of the extent L=Lmin=H.

The club face F has a height H of not less than 50 mm, preferably more than 55 mm, but not more than 85 mm, preferably less than 65 mm, and a width W of not less than 90 mm, preferably more than 100 mm, but, not more than 130 mm, preferably less than 120 mm. The area of the club face F is set in the range of not less than 4000 sq.mm, preferably more than 4000 sq.mm, but not more than 6500 sq.mm, preferably less than 5500 sq.mm.

The club face area is a surface area surrounded by the circumferential edge 2E of the club face F. If roughness such as face lines and punch mark which increases the actual surface area is provided, the increase is not counted. The area is determined assuming the club face is smooth.

The face height H is a height measured in the vertical direction between the uppermost point Pu and the lowermost point Pd on the face edge 2E under the measuring state.

The face width W is a width measured in the horizontal direction between the extreme end points Pt and Ph on the face edge 2E in the horizontal direction under the measuring state.

The measuring state is that the golf club head is set on a horizontal plane HP such that the shaft center line CL is inclined at the lie angle beta while keeping the center line CL on a vertical plane VP, and the club face F forms its loft angle with respect to the horizontal plane HP.

If the club face height H is less than 55 mm and/or the club face area is less than 4000 sq.mm, it is difficult to improve the rebound performance. If the club face height H is more than 85 mm and/or the club face area is more than 6500 sq.mm, it becomes very difficult to set the center of gravity at a good deep position, and also it becomes difficult to obtain a balanced shape.

The zone rigidity Rf of the peripheral zone 5 is preferably set in the range of not less than 40.0 and not more than 70.0, more preferably less than 60.0.

The zone rigidity Rh of the front end zone 4 is preferably set in the range of not less than 4.0, more preferably more than 4.5, but not more than 10.0, more preferably less than 9.0.

If the zone rigidity Rf is less than 40.0, the deformation of the face portion at impact becomes too large, and it is difficult to maintain the durability at a necessary level. If the zone rigidity Rf is more than 80, the mechanical impedance matching becomes difficult, and therefore it is difficult to improve the rebound performance.

If the zone rigidity Rh is less than 4.0, an energy loss due to vibration increases and durability in the front end zone decreases. If the zone rigidity Rh is more than 12.0, as the weight is increased in the face portion, it becomes difficult to set the center of gravity at a desirable depth, and the directional stability tends to deteriorate.

If the zone rigidity ratio (Rf/Rh) is more than 12.0 or less than 4.0, the difference in the mechanical impedance between the head and ball increases, and it is difficult to improve the rebound performance. Further, if more than 12.0, the energy loss due to vibration increases, which also makes it difficult to improve the rebound performance. If less than 4.0, as the deformation of the face portion increases, it becomes difficult to maintain the durability.

In connection with the selection of the materials, it is possible that the front end zone 4 (or the turnback wall 3) and peripheral zone 5 (or face portion 2) are the substantially same Young's modulus. But, it is preferable that the peripheral zone 5 (or face portion 2) is lower in the Young's modulus than the front end zone 4 (or the turnback wall 3). If such a selection of materials is possible, the Young's modulus is preferably set in a range of from 8.0 to 9.0 GPa in the front end zone 4 and in a range of from 6.8 to 7.5 GPa in the peripheral zone 5.

In order to make it possible to select metal materials having different Young's moduli, a two-piece structure made up of a face plate 2P and a open-front hollow main body 3P is employed in this embodiment. The face plate 2P corresponds to the face portion 2. The main body 3P corresponds to the crown portion 3*a*, sole portion 3*b* and side portion 3*c* which constitutes the turnback wall 3, and the hosel portion 3*d*. The face plate 2P is fixed to the main body 3P by welding the circumferential edge of the face plate 2P to the front end of the main body 3P, namely, turnback wall 3 so as to close the front opening. In this example, the main body 3P is a lost wax precision casting of a titanium alloy whereas the face plate 2 is a forging of a titanium alloy. Specifically, the main body 3P is made of a titanium alloy Ti-6Al-4V having a Young's modulus of 8.6 GPa, and the face portion 2 is made of a titanium alloy Ti-15V-6Cr-4Al having a Young's modulus of 7.1 GPa.

As to the thickness of the face portion 2, a thickness tc in the central region is set in the range of not less than 2.0 mm, preferably more than 2.5 mm, but not more than 3.5 mm, preferably less than 3.0 mm. The peripheral region surrounding the central region (in this embodiment same as the peripheral zone 5) is formed as being thinner than the central region, and the minimum thickness tf therein is preferably set in a range of from 1.6 to 2.2 mm.

As to the thickness of the main body, the thickness th in the front end zone 4 is preferably set in the range of from 1.6 to 2.2 mm. As to the remaining region other than the front end zone 4, the thickness may be set for example as follows:

in the crown portion 3*a*, not less than 0.5 mm, preferably more than 0.6 mm, but not more than 0.9 mm, preferably less than 0.75 mm;

in the sole portion 3*b*, not less than 0.5 mm and not more than 1.5 mm; and in the side portion 3*c*, not less than 0.5 mm and not more than 1.2 mm.

The hollow (i) is usually remained as being void, but it may be filled with a foamed plastic or the like.

Figure 5:
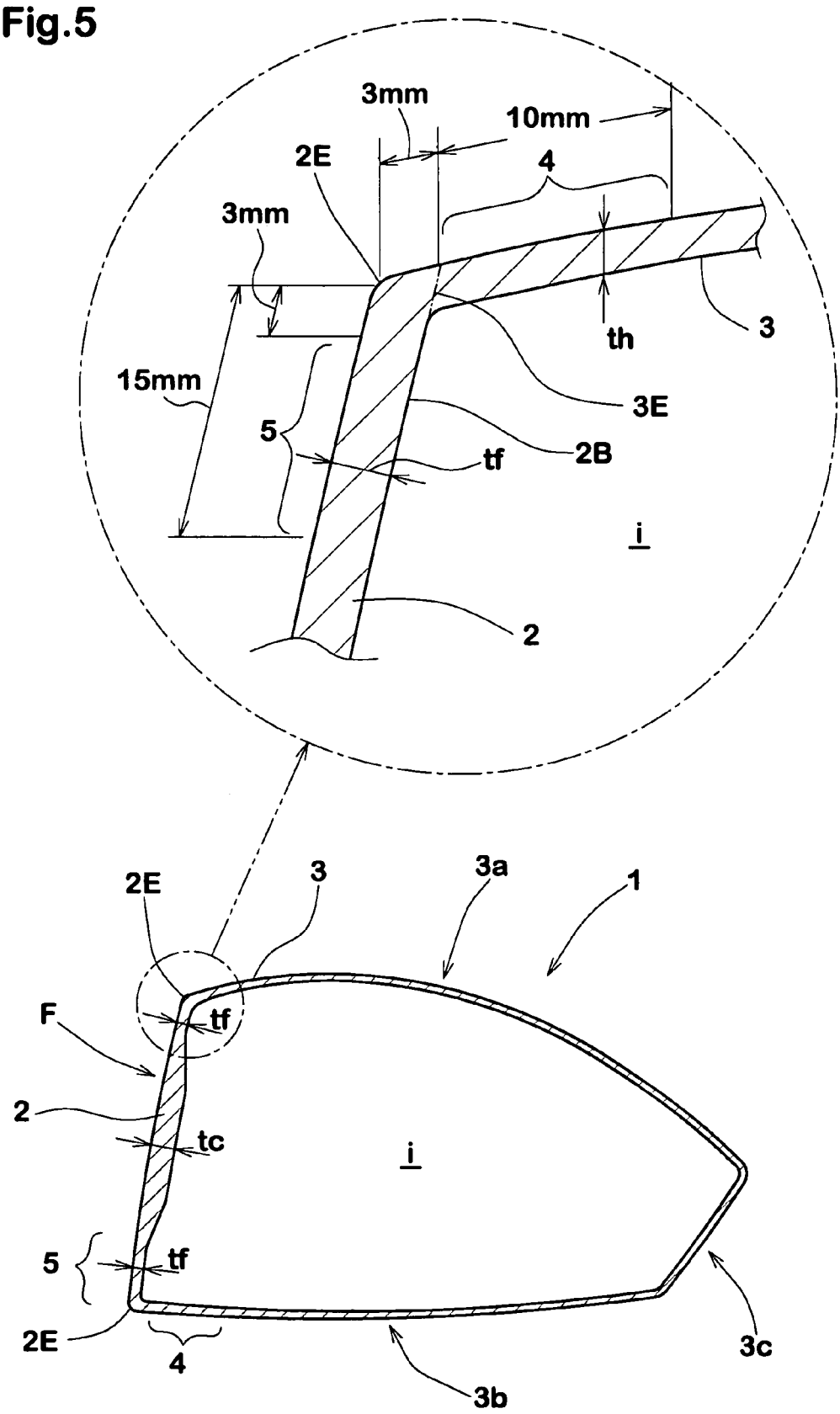
FIG. 5 is a cross sectional view taken along a line A—A in FIG. 2 and a face edge portion on larger scale.

In this embodiment, as shown in FIG. 5, the peripheral zone 5 is defined as extending between 3 mm and 15 mm from the edge 2E to avoid the inclusion of the weld junction, and the front end zone 4 is defined as extending 10 mm from the front end 3E of the turnback wall 3 (thus offset from the edge 2E is about 3 mm).

Figure 3:
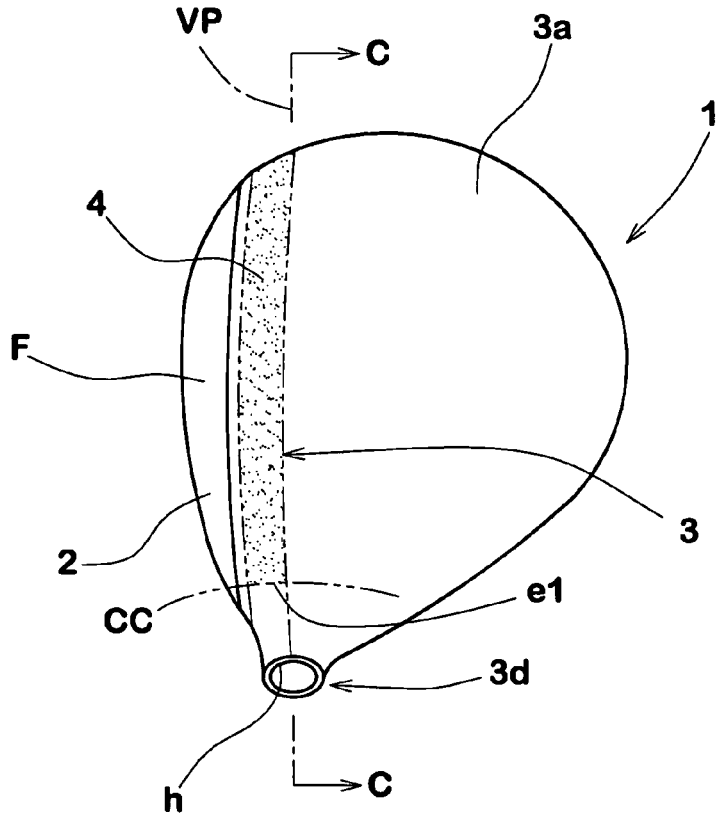
FIG. 3 is a top view thereof.
Figure 4:
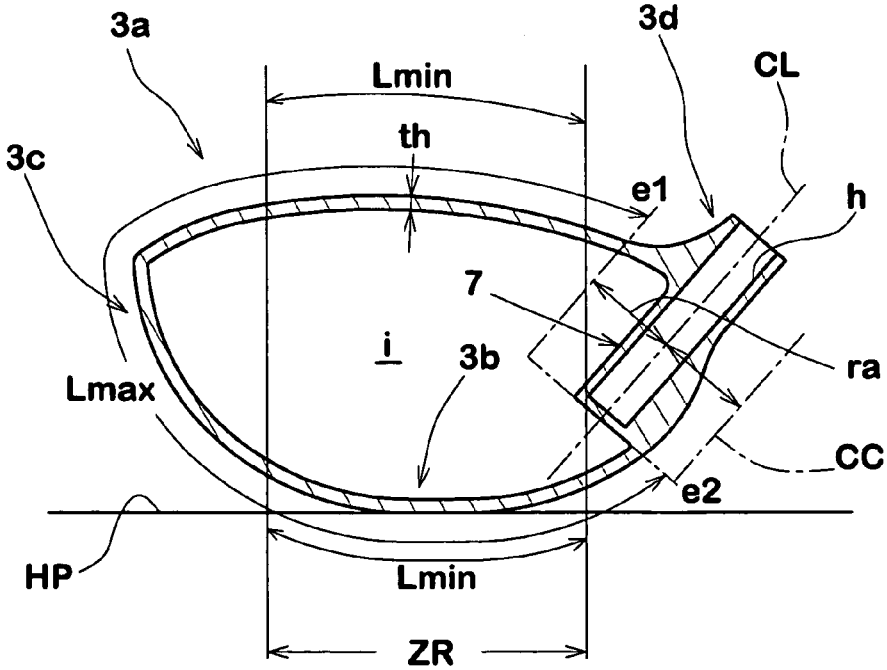
FIG. 4 is a cross sectional view taken along a line C—C in FIG. 3.

The front end zone 4 extends over the circumference, but the hosel portion 3*d* and nearby thick part as defined below are excluded because the hosel portion 3*d* interrupt the course of the front end zone 4. As shown in FIG. 4, in the crown portion 3*d*, a part which overlaps with a circular cylinder CC of a radius (ra) of 15 mm centered on the shaft centre line CL is excluded. In other words, a circumferential end e1 is set on the surface of the cylinder CC as shown in FIG. 3. In the sole portion 3*b*, the other end e2 is set at the end line of a tubular extension 7 of the hosel. In this example, therefore, the front end zone 4 extends continuously from e1 to e2 through the toe. The extent L=Lmax. It is of course possible for the extent L to be set between Lmax and Lmin.

As to the joint between the face portion 2 and turnback wall 3, the face portion 2 and turnback wall 3 in this embodiment are welded each other because these are separate metal parts. But, it is also possible to form the face portion 2 and turnback wall 3 integrally for example by forging or casting a single metal material.

In this embodiment, the primary frequency F(fix) of the frequency transfer function of the face portion is set in a range of from 650 to 850 HZ.

The definition of the primary frequency F(fix) and the method of obtaining the frequency transfer function are given bellow. Incidentally, the primary frequency F(fix) may be adjusted by changing the thickness distribution, rigidity distribution and the like of the metal materials.

Comparison Tests

Figure 7:
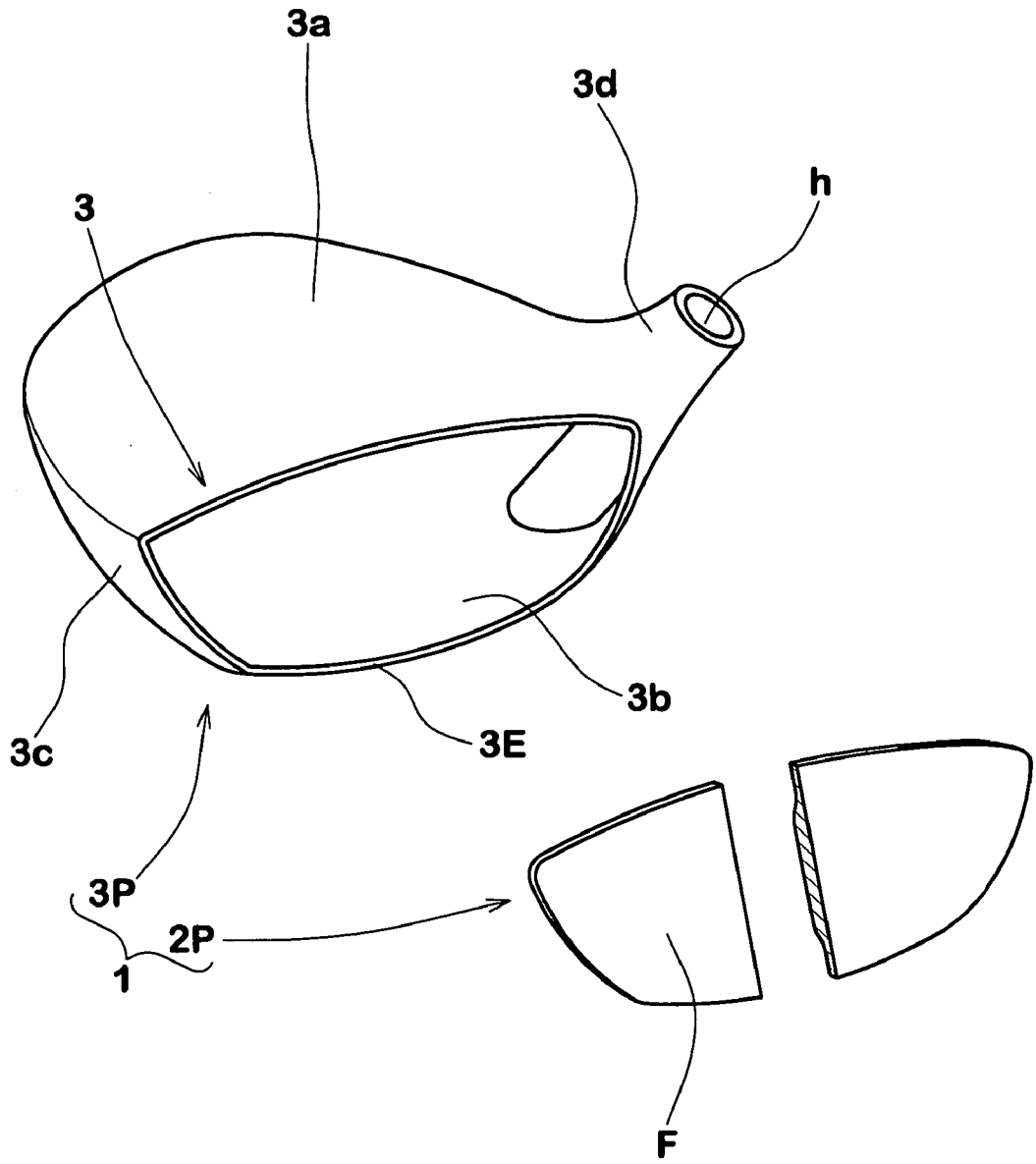
FIG. 7 is an exploded view of the club head showing a two-piece structure therefor.
Figure 8:
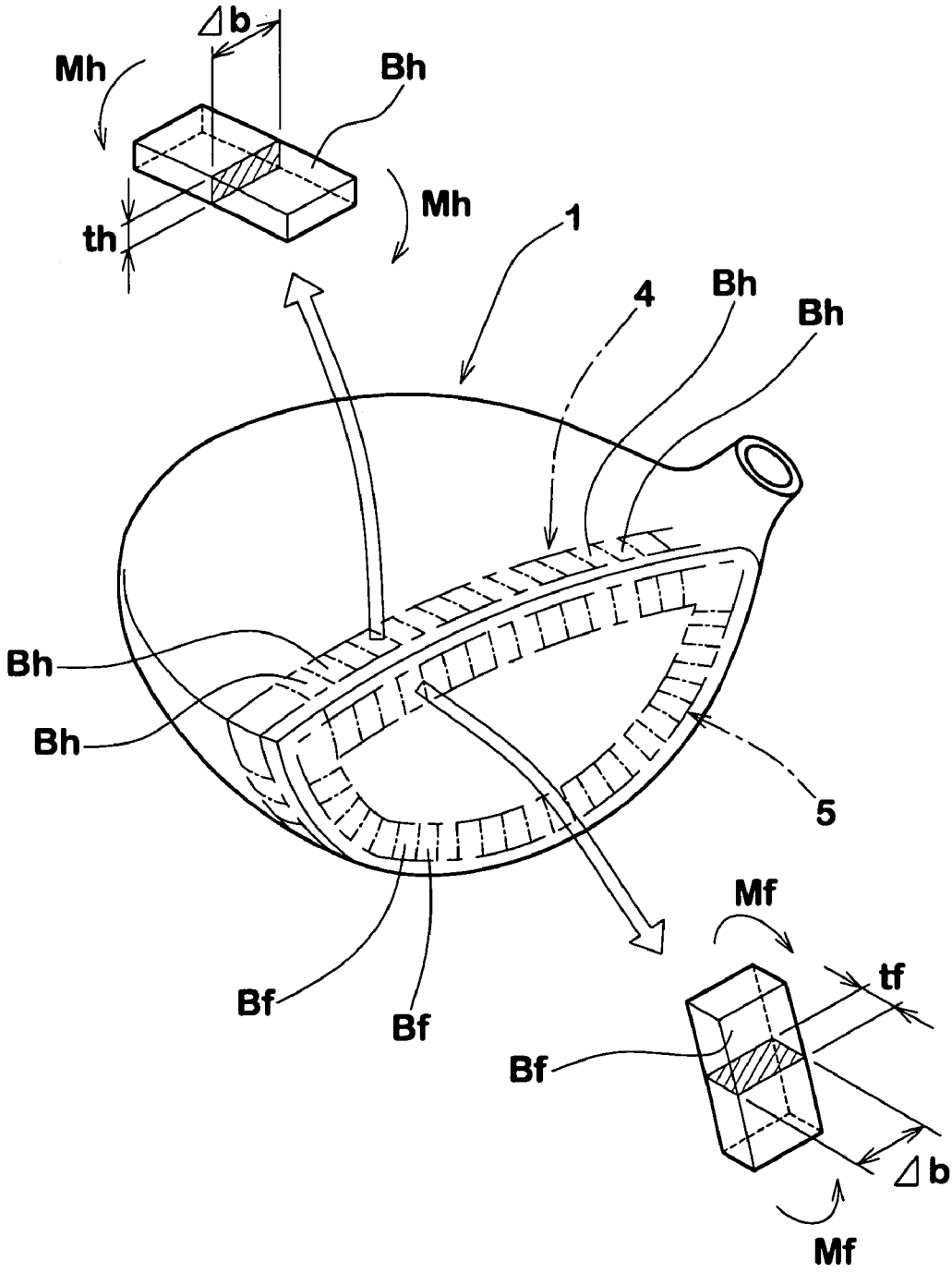
FIG. 8 is a diagram for explaining the zone rigidity of the peripheral zone and front end zone.

Wood-type golf club heads having the same two-piece structure shown in FIG. 7 composed of a face plate and main body welded each other were made and tested for the coefficient of restitution and durability. At the same time, the frequency transfer function of the face portion was measured.

Rebound Performance Test (Coefficient of Restitution)

According to the "Procedure for Measuring the velocity Ratio of a club Head for conformance to Rule 4-1e, Appendix II, Revision 2 (Feb. 8, 1999), United states Golf Association", the coefficient of restitution (e) of each club head was obtained. The results are shown in Table 1. The larger the value, the better the rebound performance.

Durability Test

The golf club head was attached to an FRP shaft to make a 46-inch wood club. The club was attached to a swing robot and hit golf balls ("DDH EXTRA SOFT" ™, manufactured by Sumitomo Rubber Industry, Ltd.) 3000 times at a head speed of 50 m/s. Then, the ball striking face was checked and if a dent was found the depth was measured.

Frequency Transfer Function

The frequency transfer function of the face portion was determined by the following vibrator method.

Figures 9A, 9B:
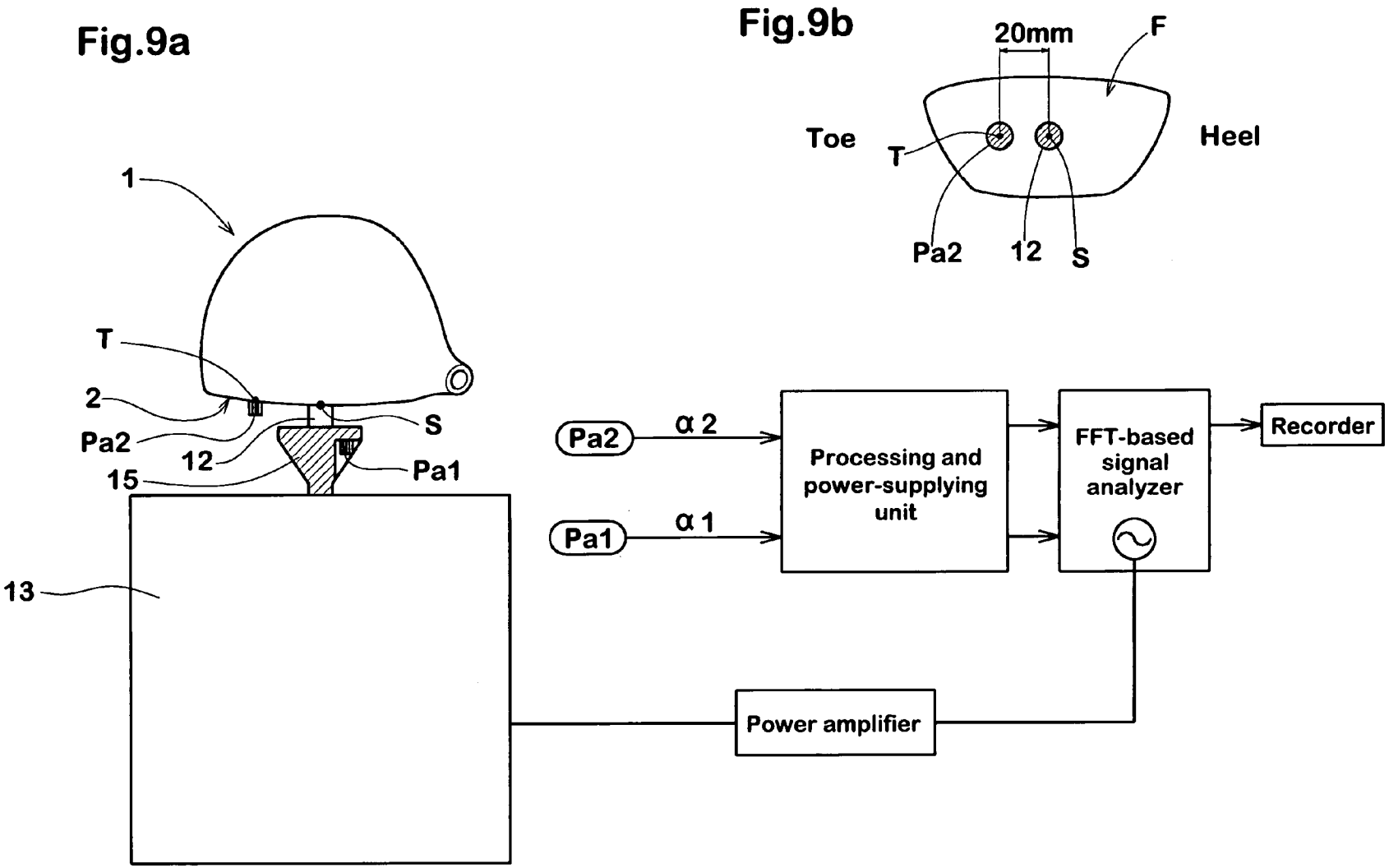
FIGS. 9*a* and 9*b* are diagrams for explaining a method of obtaining the frequency transfer function of the face portion.

In this method, as shown in FIG. 9*a*, the face portion of a head alone is vibrated by a vibrator fixed to the club face, and at the vibrating point of the club face, the input is measured with a sensor Pa1. At the same time, the response or output is measured with a sensor Pa2 at a predetermined point T on the club face (hereinafter, the "output point T"), and the frequency response function is obtained from the input and output detected by the sensors.

As to the vibrating point, the sweet spot S of the club face is used in order to minimize the moment which may be caused by the vibrating motion. The sweet spot S is defined as a point of intersection between the club face and a straight line drawn from the center of gravity of the club head perpendicularly to the club face. In practice, the sweet spot may be defined as a point on the club face at which the head placed with the face down can achieve a balance on the tip of the perpendicular pipe whose outside diameter is 2.5 mm.

The output point T is, as shown in FIG. 9*b*, defined as a point on the club face F at a distance of 20 mm toward the toe from the sweet spot S along a horizontal line passing the sweet spot under the above-mentioned measuring state.

FIG. 9*a* also shows a system of measuring the frequency response. In this system, an acceleration pickup Pa1 is used as the sensor for the input (input=acceleration α1), and an acceleration pickup Pa2 is used as the sensor for the output (output=acceleration α2).

The club head alone with the face down is fix to the top end of a cylindrical output rod 12 of a transducer 13 using an adhesive agent. The outside diameter of the cylindrical rod 12 is 10 mm, and the fixed position is the sweet spot.

The acceleration pickup Pa1 is fixed to the rod 12 using an adapter 15 to measure the acceleration at the vibrating point S of the club head. The acceleration pickup Pa2 is fixed to the above-mentioned point T of the head using an adhesive agent. During a sweep signal generated by an oscillator is applied to the transducer 13 through a power amplifier to vibrate the club head, the output signals α1 and α2 of the sensors are given to a signal analyzer through a processing and power-supplying unit to perform a power spectrum analysis based on fast Fourier transform and obtain the frequency response function(=power spectrum of acceleration α1/power spectrum of acceleration α2).

Figure 10:
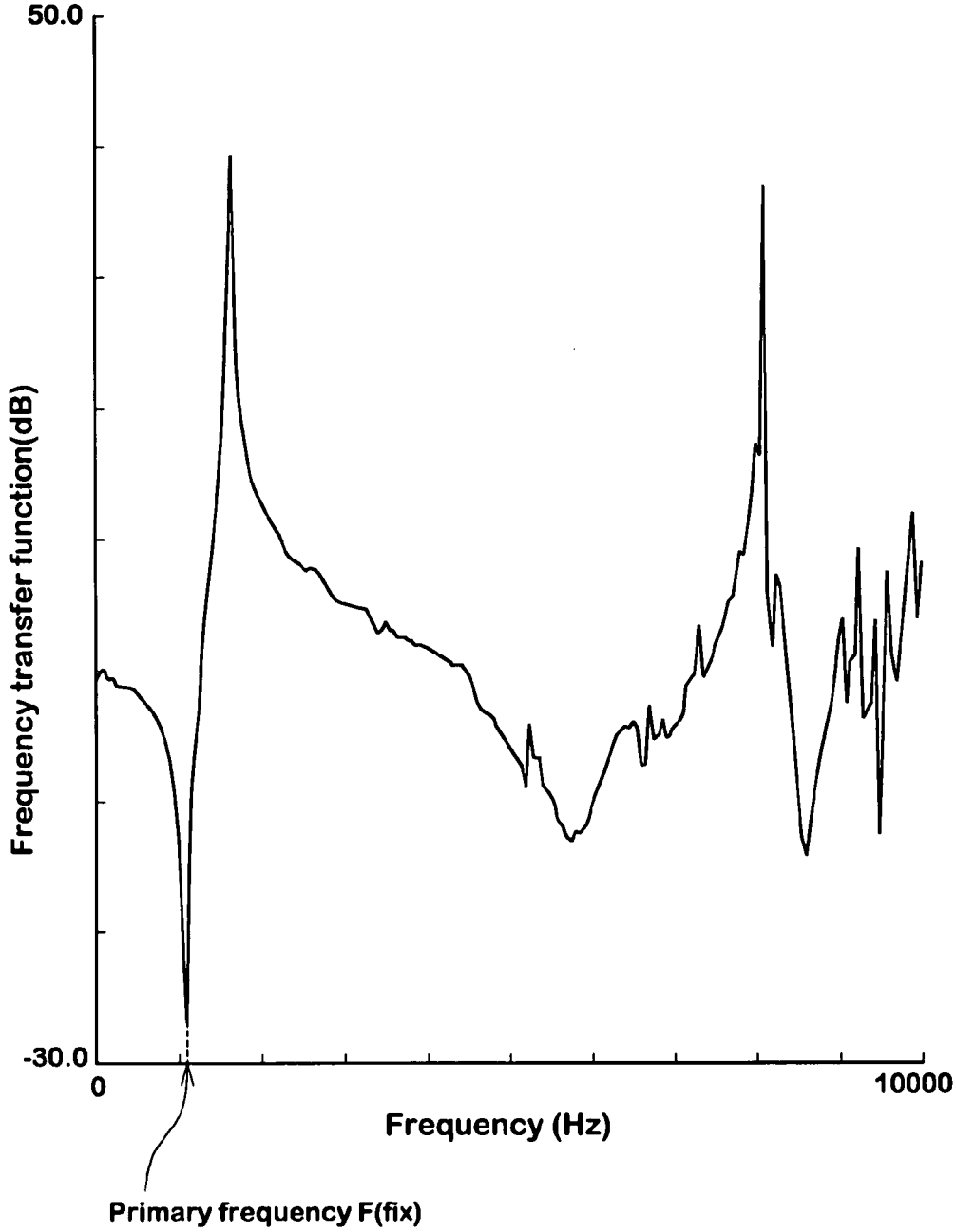
FIG. 10 is a graph showing an example of the frequency transfer function of the face portion measured by a vibration method.

The obtained frequency response function may have plurality local minimum values at different frequencies of from the first-order to n-th order modes. FIG. 10 shows an exemplary graph of the frequency response function. From such a graph, the frequency at which a local minimum value on the first-order vibration mode occurs is read as the primary frequency F(fix). In other words, the lowest in the frequencies of local minimum values is set as the primary frequency F(fix).

The obtained primary frequencies are shown in Table 1.

Figure 11:
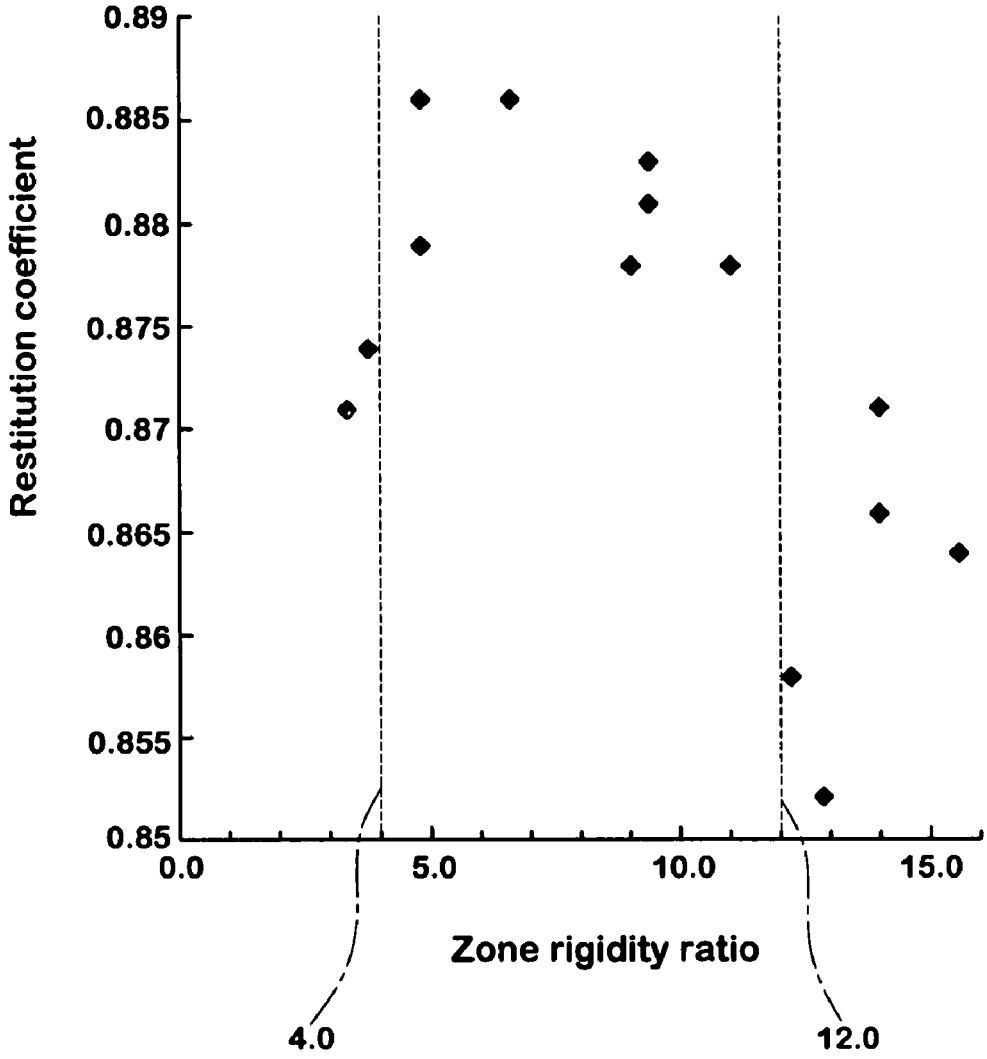
FIG. 11 is a graph of the coefficient of restitution and zone rigidity ratio.
Figure 12:
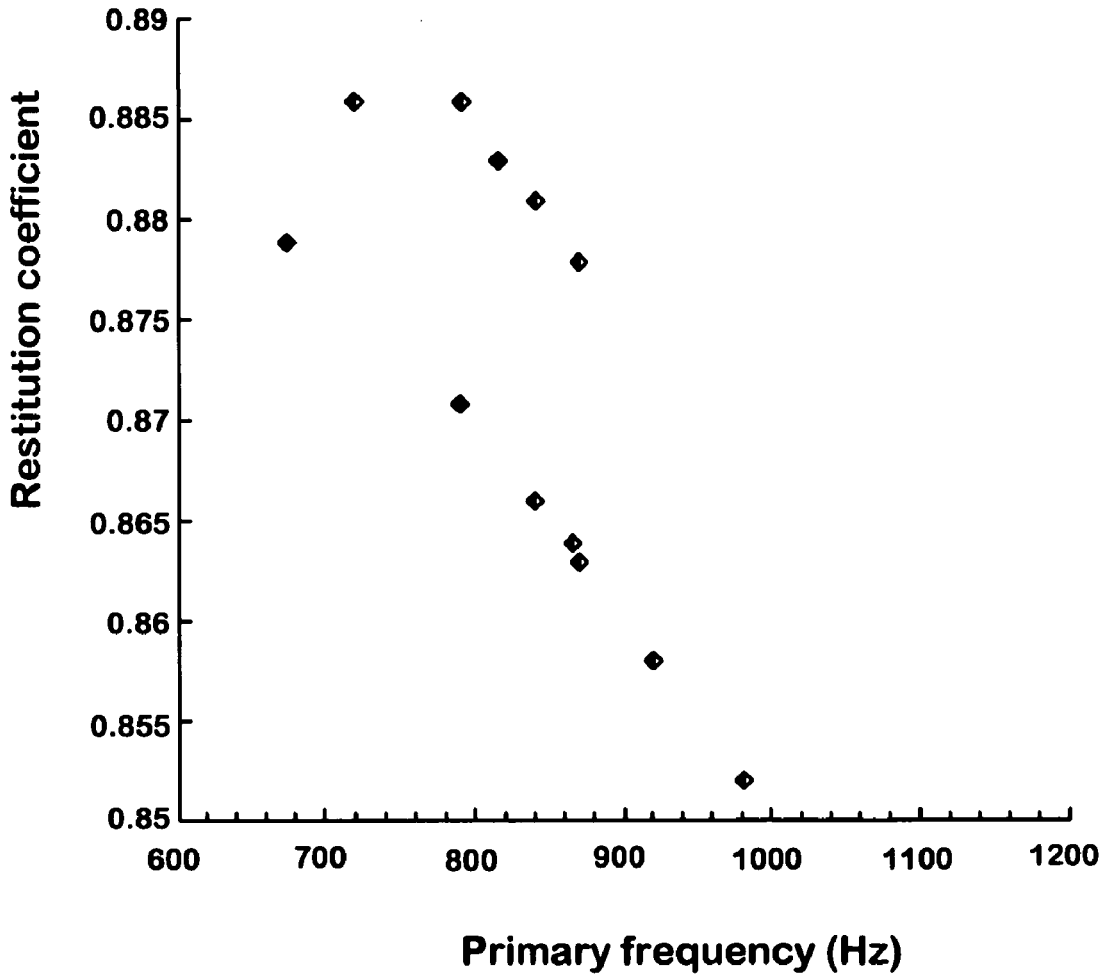
FIG. 12 is a graph of the coefficient of restitution and the primary frequency of the frequency transfer function.

The test results are listed in Table 1. Further, the data on the coefficient of restitution, zone rigidity ratio and primary frequency are plotted in graphs shown in FIGS. 11 and 12.

Form the test results, it was confirmed that the coefficient of restitution and durability can be improved by setting the zone rigidity ratio as explained above. Further, the coefficient of restitution can be improved by setting the primary frequency under 850 Hz in combination with the zone rigidity ratio limitation.

The present invention is suitably applied to a large sized club head having a head volume in a range of not less than 440 cc, preferably more than 450 cc. However, in view of increase in the weight or decrease in the durability, it is preferable that the head volume is limited to not more than 650 cc, more preferably less than 600 cc, still more preferably less than 560 cc.

As described above, in the golf club head according to the present invention, as the zone rigidity ratio is specifically defined, the rebound performance is improved to increase the traveling distance of the ball although the head volume is very large.

The invention claimed is:

1. A hollow metal club head comprising a face portion whose front surface defines a club face for hitting a ball, and a turnback wall extending backward from a circumferential edge of the face portion, wherein a head volume is in a range of not less than 440 cc, a height of the club face is in a range of from 55 to 85 mm, a surface area of the club face is in a range of from 4000 to 6500 sq.mm, and in a front end zone of the turnback wall and a peripheral zone of the face portion which are adjacent to each other through a junction between the turnback wall and the face portion, the ratio Rf/Rh of a zone rigidity Rf of the peripheral zone to a zone rigidity Rh of the front end zone is in a range of from 4.0 to 12.0, wherein $$Rh=Eh\times th^3$$

$$Rf=Ef\times tf^3$$

TABLE 1

| | | Face portion | | | | Turnback wall | | | | | | | |
|---|---|---|---|---|---|---|---|---|---|---|---|---|---|
| Head | Head volume (cc) | Material* | Young's modulus (Gpa) | Thickness tf (mm) | Zone rigidity Rf | Material* | Young's modulus (Gpa) | Thickness th (mm) | Zone rigidity Rh | Rf/Rh | Coefficient of Restitution | Primary frequency (Hz) | Durability (mm) |
| Ex. 1 | 450 | DAT55G | 7.05 | 2 | 56.4 | 6-4Ti | 8.6 | 0.9 | 6.27 | 9 | 0.878 | 870 | 0.03 |
| Ex. 2 | 450 | DAT55G | 7.05 | 1.8 | 41.12 | 6-4Ti | 8.6 | 0.8 | 4.4 | 9.3 | 0.881 | 841 | 0.05 |
| Ex. 3 | 480 | DAT55G | 7.05 | 1.8 | 41.12 | 6-4Ti | 8.6 | 0.8 | 4.4 | 9.3 | 0.883 | 816 | 0.08 |
| Ex. 4 | 500 | DAT55G | 7.05 | 1.8 | 41.12 | 6-4Ti | 8.6 | 1 | 8.6 | 4.8 | 0.886 | 792 | 0.09 |
| Ex. 5 | 550 | DAT55G | 7.05 | 1.8 | 41.12 | 6-4Ti | 8.6 | 1 | 8.6 | 4.8 | 0.886 | 721 | 0.1 |
| Ex. 6 | 600 | DAT55G | 7.05 | 1.8 | 41.12 | 6-4Ti | 8.6 | 1 | 8.6 | 4.8 | 0.879 | 675 | 0.1 |
| Ref. 1 | 450 | DAT55G | 7.05 | 2 | 56.4 | 6-4Ti | 8.6 | 0.7 | 2.95 | 19.1 | 0.863 | 870 | 0.1 |
| Ref. 2 | 450 | DAT55G | 7.05 | 2 | 56.4 | 6-4Ti | 8.6 | 0.75 | 3.63 | 15.6 | 0.864 | 865 | 0.04 |
| Ref. 3 | 450 | DAT55G | 7.05 | 1.8 | 41.12 | 6-4Ti | 8.6 | 0.7 | 2.95 | 13.9 | 0.866 | 840 | 0.11 |
| Ref. 4 | 450 | SP700 | 9.3 | 1.8 | 54.24 | 6-4Ti | 8.6 | 0.8 | 4.4 | 12.3 | 0.858 | 920 | 0.1 |
| Ref. 5 | 450 | 6-4Ti | 9.7 | 1.8 | 56.57 | 6-4Ti | 8.6 | 0.8 | 4.4 | 12.9 | 0.852 | 980 | 0.03 |
| Ref. 6 | 450 | DAT55G | 7.05 | 1.8 | 41.12 | 6-4Ti | 8.6 | 0.7 | 2.95 | 13.9 | 0.871 | 590 | 0.35 |
| Ref. 7 | 450 | DAT55G | 7.05 | 1.6 | 28.88 | 6-4Ti | 8.6 | 1 | 8.6 | 3.4 | 0.871 | 595 | broken |
| Ref. 8 | 450 | DAT55G | 7.05 | 1.5 | 23.79 | 6-4Ti | 8.6 | 0.9 | 6.27 | 3.8 | 0.874 | 563 | broken |
| Ex. 7 | 450 | DAT55G | 7.05 | 2 | 56.4 | 6-4Ti | 8.6 | 1 | 8.6 | 6.6 | 0.886 | 892 | 0.02 |
| Ex. 8 | 450 | DAT55G | 7.05 | 1.9 | 48.36 | 6-4Ti | 8.6 | 0.8 | 4.4 | 11 | 0.878 | 871 | 0.02 |

*DAT55G: Ti—15V—6Cr—4Al, 6—4Ti: Ti—6Al—4V, SP700: Ti—4.5Al—3V—2Mo—2Fe
Thickness other than Peripheral zone and Front end zone
Face portion tc: 2.7 mm
Crown portion: 0.7 mm
Sole portion: 1.0 mm
Side portion: 0.7 mm Eh is Young's modulus in GPa of the turnback wall in the front end zone, th is average thickness in mm of the turnback wall in the front end zone, Ef is Young's modulus in GPa of the face portion in the peripheral zone, and tf is average thickness in mm of the face portion in the peripheral zone.

2. The club head according to claim 1, wherein a primary frequency of a frequency transfer function of the face portion is in a range of from 650 to 850 HZ.

3. The club head according to claim 1, wherein the peripheral zone extends continuously along the circumferential edge of the club face.

4. The club head according to claim 1, wherein the front end zone extends across at least a range (ZR) having a width corresponding to a height (H) of the club face and centered on the centroid (S) of the club face.

5. The club head according to claim 1, wherein the front end zone extends 10 mm backwards from the front end of the turnback wall, and the peripheral zone extends between 3 mm and 15 mm from the circumferential edge of the club face towards the centroid of the club face.

6. The club head according to claim 1, wherein the front end zone extends between 3 mm and 13 mm backward from the circumferential edge of the club face, the peripheral zone extends between 3 mm and 15 mm from the circumferential edge of the club face towards the centroid of the club face.

7. The club head according to claim 1, wherein the Young's modulus in the peripheral zone is the same as the Young's modulus in the front end zone.

8. The club head according to claim 1, wherein the Young's modulus in the peripheral zone is smaller than the Young's modulus in the front end zone.

9. The club head according to claim 1, wherein the face portion is made of a metal material, and in the front end zone, the Young's modulus is in a range of from 8.0 to 9.0 GPa and the average thickness th is in a range of from 0.7 to 1.2 mm, and the turnback wall is made of a metal material, and in the peripheral zone, the Young's modulus is in a range of from 6.8 to 7.5 GPa and the average thickness tf is in a range of from 1.6 to 2.2 mm.

* * * * *